United States Patent [19]

Muller

[11] Patent Number: 5,035,450

[45] Date of Patent: Jul. 30, 1991

[54] DOOR EXIT-DELAYING MEANS

[75] Inventor: Peter H. Muller, Los Gatos, Calif.

[73] Assignee: Von Duprin, Inc., Indianapolis, Ind.

[21] Appl. No.: 483,798

[22] Filed: Feb. 23, 1990

[51] Int. Cl.[5] ..... F05C 15/02

[52] U.S. Cl. ..... 292/92; 292/341.16; 292/DIG. 65

[58] Field of Search ..... 292/341.16, 201, 144, 292/DIG. 69, 21, 92, DIG. 65

[56] References Cited

U.S. PATENT DOCUMENTS

| | | | |
|---|---|---|---|
| 3,765,709 | 10/1973 | Van Wyck | 292/341.16 |
| 3,872,696 | 3/1975 | Geringer | 70/432 |
| 4,032,180 | 6/1977 | Pohl | 292/DIG. 69 |
| 4,132,439 | 1/1979 | Millar | 292/144 |
| 4,257,631 | 3/1981 | Logan, Jr. | 292/92 |
| 4,324,425 | 4/1982 | Logan | 292/DIG. 65 |
| 4,354,699 | 10/1982 | Logan | 292/201 |
| 4,529,234 | 7/1985 | Senften | 292/341.16 |
| 4,613,176 | 9/1986 | Kelly | 292/DIG. 60 |
| 4,904,005 | 2/1990 | Frolov | 292/251.5 |

*Primary Examiner*—Eric K. Nicholson

*Attorney, Agent, or Firm*—Walter C. Vliet; Bernard J. Murphy

[57] ABSTRACT

In a first embodiment, the invention has a casing set in the frame of a door in confronting relationship to the latchbolt-confining housing of the door. A bolt, translatable in the casing, is extended, by a solenoid, and enters the housing to prevent opening of the door. A latchbolt position sensor, in the form of a dual-ended limb, monitors the position of the latchbolt. Upon withdrawal of the latchbolt, from latching closure of the door, the limb actuates a switch to operate a time delay circuit component. When the specified time delay set by the component has run its course, it cuts power to the solenoid. Compression springs withdraw the bolt from the latchbolt-confining housing, to permit the door to open.

13 Claims, 5 Drawing Sheets

12
18
50
32
16
10
30
36
34
52
40
38
42
26
28
24
46
48

20
50
36
30
30
54
56
58

DOOR EXIT-DELAYING MEANS

This invention pertains to door hardware, and in particular to means for delaying exit, via a door, for relevant purposes. There are circumstances in which an immediate egress is not desirable, and the invention is drawn to meeting such circumstances.

In retail stores, for instance, it is frequently desirable to introduce a delayed egress via one or more doors, in that shop-lifting is so widespread. Consequently, if the exiting can be delayed for a brief period of time, fifteen seconds or so, and an audible signal emitted when the door is tried, it will afford store personnel an opportunity to monitor the party who is attempting an exit.

Too, in hospitals and/or nursing homes, there need to be secure exits which, for reasons of safety, will afford exiting but, also, will briefly delay such just long enough so that responsible attendants can ascertain the competence of those using the exit. If ill or disoriented persons try the door, and can be delayed long enough for signal to be emitted, they can be prevented from putting themselves in harm's way.

It is an object of this invention to meet the aforesaid need for door exit-delaying means; in the builders' hardware industry, such means are referred to as Special Locking Arrangements.

It is particularly an object of this invention to set forth means for engaging the latchbolt-confining housing of a door, for delaying exit via the door, comprising a support for mounting thereof to the frame of a door in confronting relationship to the latchbolt-confining housing of the door; first means mounted to said support for (a) intrusion thereof into said housing to prevent door movement, in a first disposition, and (b) withdrawal from said housing, in a second disposition, to permit door movement; and second means mounted to said support operative in response to, and with a specific time delay following, a retraction of a housing-confined latchbolt into said housing for changing said first means from one of said dispositions thereof to the other.

Another object of the invention is to disclose means for engaging a movable edge of a door, for delaying exit via the door, comprising a support for mounting thereof to the frame of a door in confronting relationship to a movable edge of the door; first means mounted to said support for (a) intrusion thereof into a movable edge of the door to prevent door movement, in a first disposition, and (b) withdrawal from said edge, in a second disposition, to permit door movement; and second means for mounting thereof to the frame of a door operative in response to, and with a specific time delay following, a retraction of the door latchbolt, for changing said first means from one of said dispositions thereof to the other.

It is also a further object of this invention to set forth means for engaging a door, for delaying exit via the door, comprising a support for mounting thereof to the frame of a door in adjacency to a peripheral surface of the door; first means mounted to said support for (a) overlying a surface of the door, in a first disposition, to prevent door movement, and (b) withdrawal from said door surface, in a second disposition, to permit door movement; and second means for mounting thereof to the frame of a door operative in response to, and with a specific time delay following, a retraction of the door latchbolt, for changing said first means from one of said dispositions thereof to the other.

Further objects of this invention, as well as the novel features thereof, will become more apparent by reference to the following description, taken in conjunction with the accompanying figures, in which.

Only for exemplary purposes the invention is shown in association with a door having a panic exit type of mechanism. As will be appreciated, however, from the following, the invention is not limited to such an application. One or more of the embodiments thereof are equally useful with doors having other types of latching/unlatching mechanisms.

Figure 1:
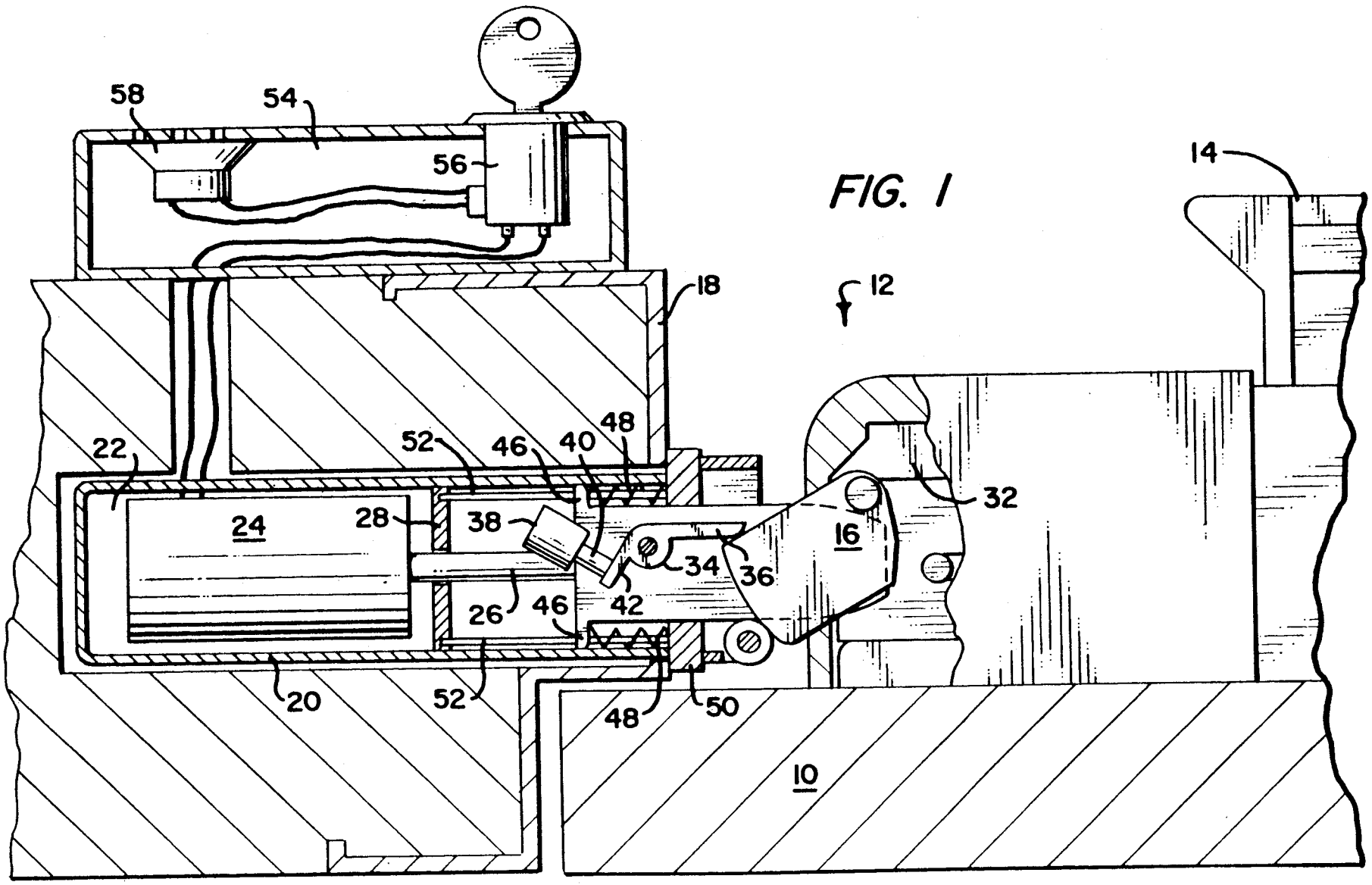
FIG. 1 is a top view, partly in cross-section, of an embodiment of the invention.

As shown in FIG. 1, a door 10 has a panic exit mechanism 12 mounted thereon. Mechanism 12, as is well known from the prior art, has a push pad 14 (only a portion thereof being shown) which, when pushed inwardly, causes the latchbolt 16 to retract from a strike in order that the door may be opened.

The door frame 18, according to this embodiment of the invention, is broached to nest therein a casing 20 which provides a support for several of the components of the novel door exit-delaying means. The casing defines a chamber 22 in which is mounted a solenoid 24. The solenoid 24 has a push rod 26 extending therefrom, the latter being in penetration of a partition 28 fixed in the chamber 22. The foremost end of the push rod 26 is in abutting engagement with an innermost end of a bolt 30. The outermost end of the bolt 30 is intruded into the housing 32 in which the latchbolt is confined.

Figure 2:
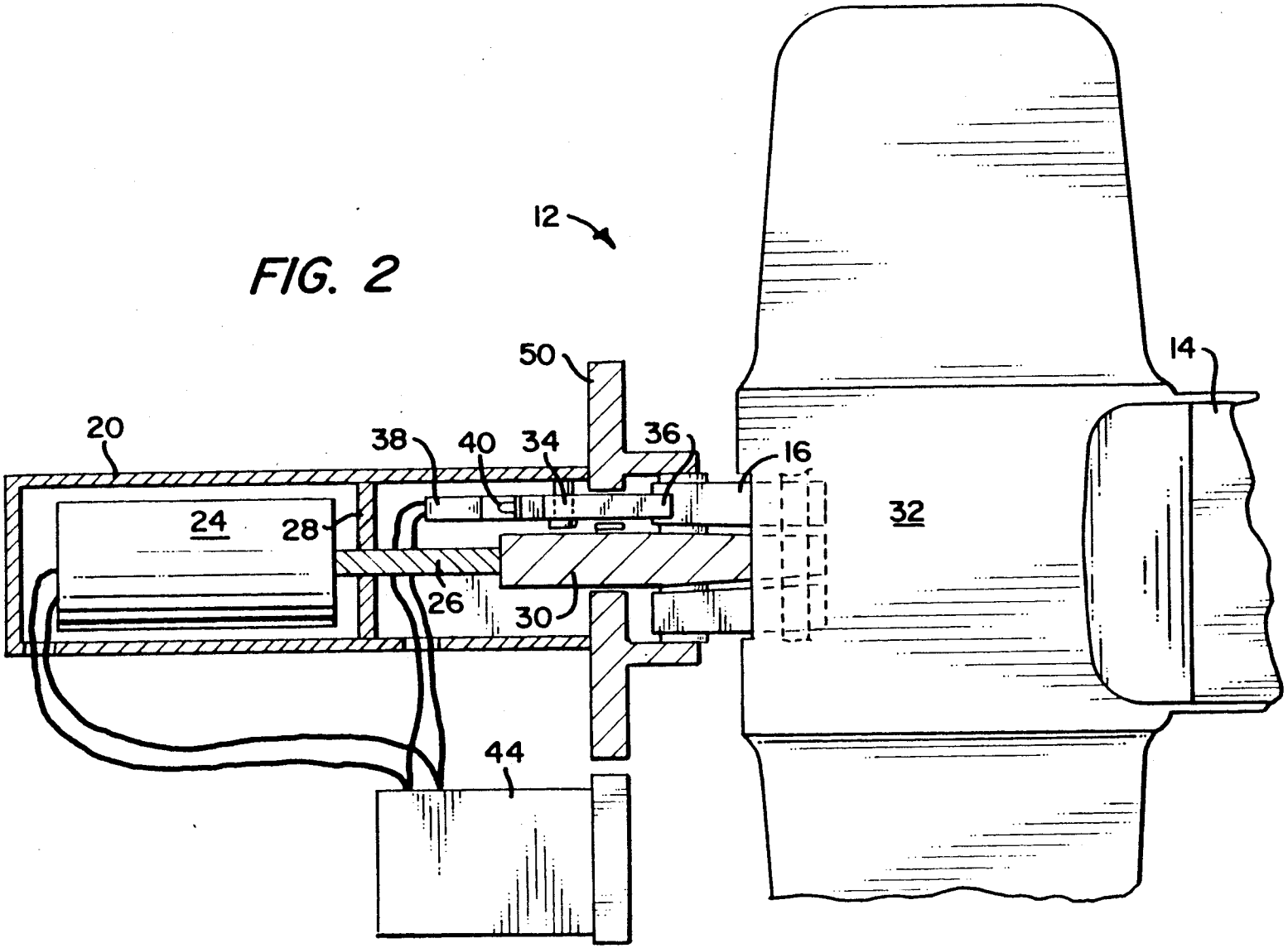
FIG. 2 is a cross-sectional view of the FIG. 1 embodiment, the same being generally a vertical section.

With further reference to FIG. 2 also, it will be seen that the latchbolt 16 has a bifurcated end, and the bolt 30 is entered therein. Accordingly, even if the push pad 14 is operated, and the latchbolt 16 is retracted into its housing 32, the door cannot be opened; the bolt 30 prevents door movement.

A dual-ended limb 34 is rotatably mounted in the casing 20, and one end 36 of the limb is disposed for latchbolt engagement, as a means of serving as a latchbolt position sensor. A spring (not shown) biasingly urges the end 36 in engagement with the latchbolt 16.

Figure 7:
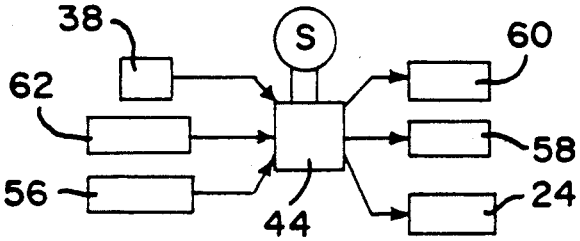
FIG. 7 is a block diagram of the electrical relationships of components employed in each of the embodiments.

Also mounted in the casing 20 is a time delay switch 38. The switch 38 has a prominent actuator 40 which is engaged by the other end 42 of the limb 34. With push pad-actuated retraction of the latchbolt 16, the limb 34 rotates slightly (in a clockwise direction as viewed in FIGS. 1 and 3) and, as a consequence thereof, displaces the actuator 40 to actuate the switch 38. The switch 38 is electrically wired to a time delay circuit component 44 which, in turn, is electrically wired to the solenoid 24 (FIGS. 2 and 7).

Under normal conditions, the solenoid 24 is energized and, therefore, keeps the bolt 30 in engagement with the latchbolt housing 32; i.e., the solenoid keeps the push rod 26 fully extended. However, with retraction of the latchbolt 16, and the concomitant actuation of the switch 38 by the end 42 of the limb 34, a preset time delay, controlled by component 44, proceeds to run out; the delay may, for example, be fifteen seconds. When the fifteen seconds have expired, the time delay component 44 cuts the power ("S", FIG. 7) to the solenoid 24 to cause its de-energization. As explained in the following, then, the bolt 30 withdraws from the latchbolt housing 32 to allow the door 10 to be opened.

The bolt 30 has a pair of projecting lugs 46 which serve as lands against which compression springs 48 bear, the spring reacting from the wall defined by the mounting plate 50 of the casing 20. With the solenoid de-energized, the springs 48 cause the bolt 30 to retract into the casing 20, and the rod 26 to move into the solenoid 24. This condition is shown in FIG. 3.

The lugs 46 are apertured and slidably and guidably traverse along a pair of rods 52. The rods 52 are fixed, in parallel, at one end of each, in the partition 28.

Figure 3:
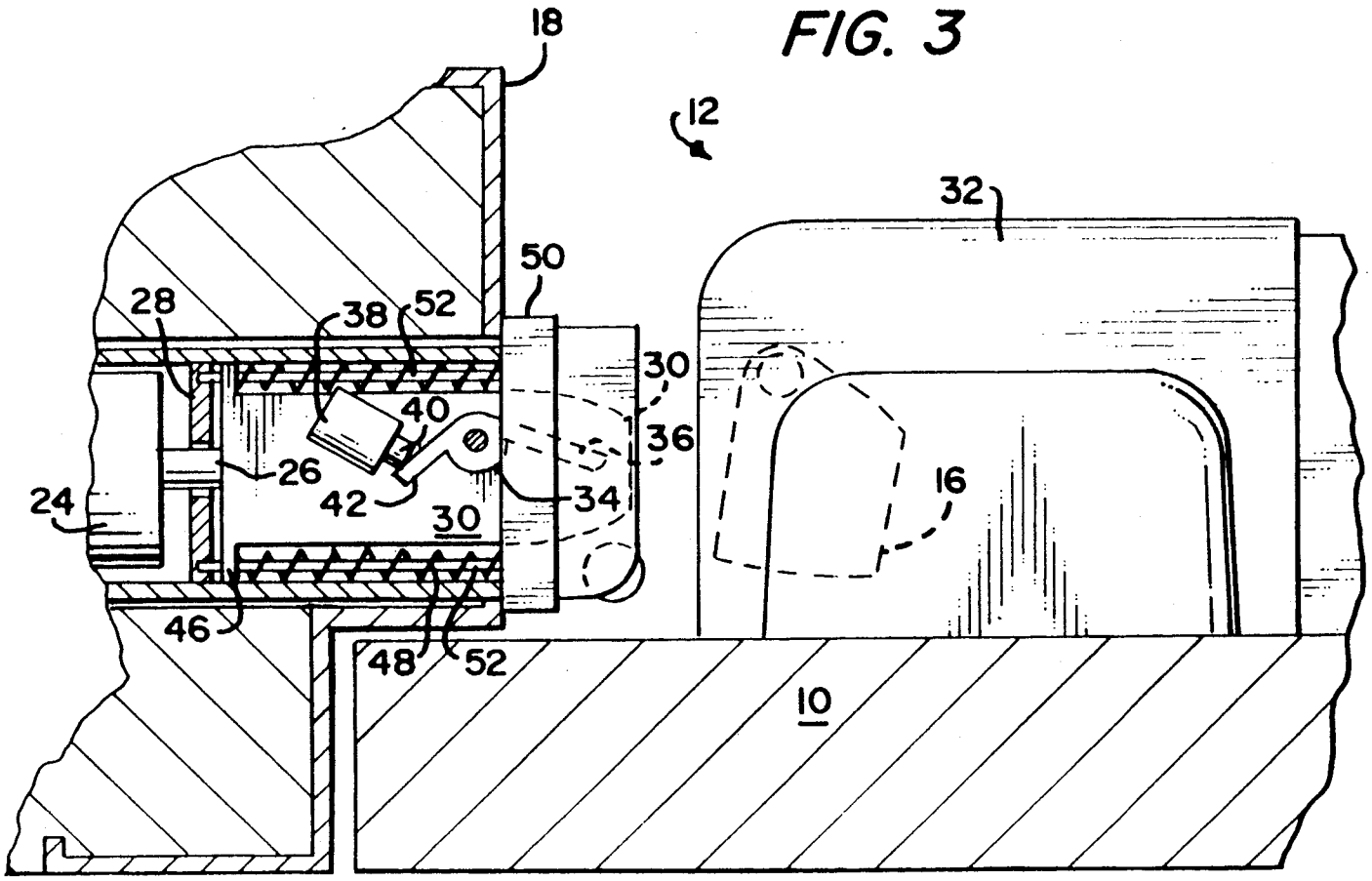
FIG. 3 is a view similar to that of FIG. 2.

As the door 10 closes again, its latchbolt 16 engages the limb 34 at the end 36 thereof, and causes the limb 34 to rotate back (counterclockwise) to the attitude thereof as shown in FIG. 1 from the attitude it had as shown in FIG. 3. Hence, the delay mechanism is reset; the solenoid is reenergized, and extends the push rod 26 forward to cause the bolt 30 to reenter the latchbolt housing 32.

Figure 4:
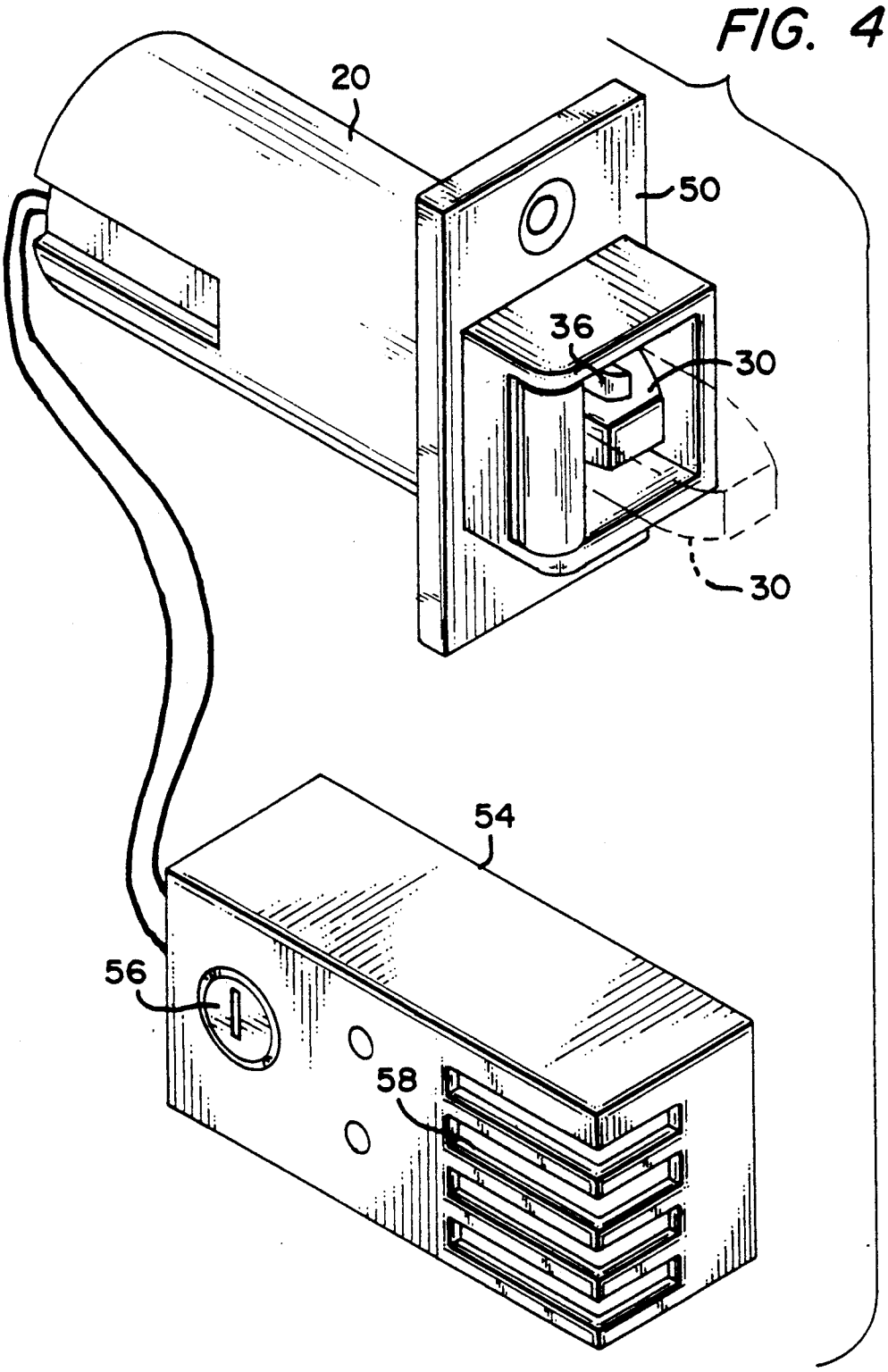
FIG. 4 is a perspective view of the mechanism housing and the control box.

The control box 54 houses a key-switch 56 and a horn 58 (FIGS. 1, 4, and 7). The key-switch 56 is appropriately wired into the circuitry to enable a cognizant person to de-energize the solenoid 24 to permit overriding the delay arrangement. Too, the horn 58 is wired into the circuitry to give an audible alarm when the latchbolt 16 is retracted (i.e., with the commencement of the time delay period). In addition to the horn 58, the arrangement can include lamps 60 (FIG. 7).

Albeit shown in adjacent to the casing 20, the control box 54 and/or the time delay component 44 can be remotely located; they have only to be electrically joined to the switch 38 and the solenoid 24.

In accordance with applicable fire codes, it is likely that it will be necessary for the invention to be overriden by an external fire alarm signal. This, too, is contemplated by the fire alarm "signal" represented by the index number 62 (FIG. 7). An input fire alarm signal will de-energize the solenoid 24 to allow the bolt 30 to retract from the latchbolt housing 32.

In this connection, it is to be noted that the invention is fail safe in that, upon the event of an electrical failure, the solenoid will de-energize and release the door.

The embodiment of the invention disclosed by FIGS. 1 through 5 comprehends its use with a latchbolt which has a bifurcated end, in order that the bolt 30 can gain entry into the latchbolt housing 32. In those circumstances in which the latchbolt is not bifurcated, alternate embodiments of the invention can be practiced, and perhaps offer a simpler retrofit thereof.

Figure 6:
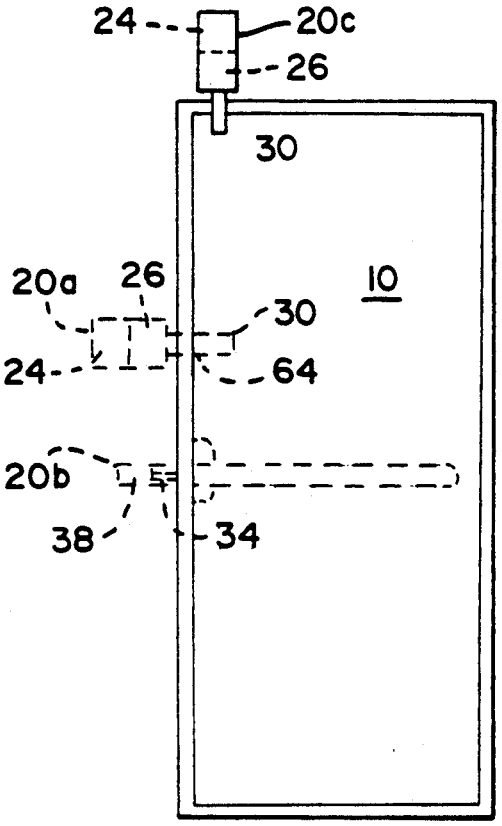
FIG. 6 is a simple line drawing of alternate embodiments of the invention.
Figure 5:
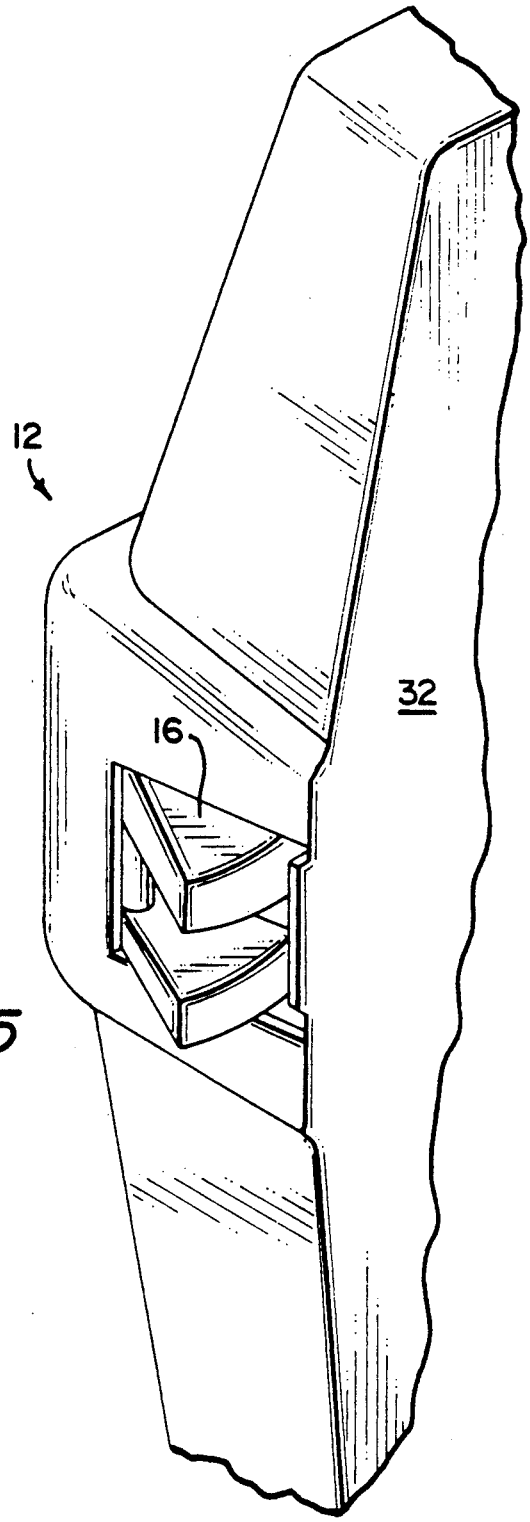
FIG. 5 is a fragmentary, perspective view of the latchbolt and latchbolt housing of a door.

In FIG. 6 two alternate embodiments are represented. In a first of these embodiments, a casing **20*a* is nested in the frame 18 of the door 10. Casing 20*a* contains the solenoid 24, push rod 26 and bolt 30, and to accommodate the bolt 30, an edge of the door 10 has a bore 64 formed therein. Another casing 20*b* is set into the frame 18 (whereat casing 20 of the FIGS. 1–5 embodiment is located). Within casing 20*b* are located the dual-ended limb 34 and the time-delay switch 38. Although the casings 20*a* and 20*b* are spaced apart, the switch 38 is wired (as in the first embodiment of the invention) to the time delay circuit component 44—located wherever is desirable—and the latter is wired to the solenoid 24 in casing 20*a***.

The second alternate embodiment in FIG. 6 contemplates the use again of casing **20*b*, but here a casing 20*c*, containing the solenoid 24, push rod 26 and bolt 30, is set in adjacency to a periphery of a swing, top edge of the door 10, and on the side of the door 10 which is opposite the panic exit mechanism 12. Too, the casing 20*c* is so arranged that, with extension of the bolt 30**, it comes into an overlying engagement with the surface of the door.

While I have described my invention in connection with specific embodiments thereof, it is to be clearly understood that this is done only by way of example and not as a limitation to the scope of the invention as set forth in the objects thereof, and in the appended claims.

I claim:

1. For mounting to a frame of a doorway, in which a door having a latchbolt-confining housing is mounted, means for engaging the latchbolt-confining housing of such door, for delaying exit via the door, comprising:

a support mountable to such frame of a doorway in confronting relationship to the latchbolt-confining housing of the door;

first means mounted to said support for (a) intrusion thereof into said housing to prevent door movement, in a first disposition, and (b) withdrawal from said housing, in a second disposition, to permit door movement; and second means mounted to said support operative in response to, and with a specific time delay following, a retraction of a housing-confined latchbolt into said housing for changing said first means from one of said dispositions thereof to the other.

2. Exit-delaying and housing-engaging means, according to claim 1, wherein:

said support includes a casing for nesting within the aforesaid frame of a doorway;

said casing defines a chamber therewithin; and said first means comprises a bolt reciprocably mounted in said chamber.

3. Exit-delaying and housing-engaging means, according to claim 1, wherein:

said second means comprises a latchbolt-position sensor.

4. Exit-delaying housing-engaging means, according to claim 3, wherein:

said sensor comprises a limb pivotably mounted in said support, and means biasingly urging said limb into a latchbolt-contacting disposition.

5. Exit-delaying and housing-engaging means, according to claim 2, wherein:

said second means comprises a latchbolt-position sensor;

said sensor comprises a dual-ended limb pivotably mounted in said chamber, and means biasingly urging one end of said limb into a latchbolt-contacting disposition.

6. Exit-delaying and housing-engaging means, according to claim 5, wherein:

said second means further comprises a solenoid, confined in said chamber, and engaged with said bolt for effecting reciprocation of said bolt, and time-delay means, electrically coupled to said solenoid, for causing said solenoid to effect bolt reciprocation.

7. Exit-delaying and housing-engaging means, according to claim 6, wherein:

said time delay means comprises a switch mounted in said chamber;

said switch has a contractor normally engaged with the other end of said dual-ended limb; and said time delay means further comprises a time-delay circuit component electrically coupled, interpositionally, between said switch and said solenoid.

8. Exit-delaying and housing-engaging means, according to claim 6, wherein:

said solenoid has a push rod extending therefrom and abuttingly engaged with an end of said bolt.

9. Exit-delaying and housing-engaging means, according to claim 2, wherein:

said casing has a wall at one end thereof;

said bolt has means extending therefrom defining an abutment; and means interposed between said wall and said abutment-defining means for urging said bolt in a given reciprocable direction.

10. Exit-delaying and housing-engaging means, according to claim 9, wherein:

said abutment-defining means comprises a pair of lugs extending, perpendicularly, from opposite sides of said bolt; and further including means fixed in said casing, and engaged with said lugs, for guiding said bolt in reciprocation.

11. Exit-delaying and housing-engaging means, according to claim 10, wherein:

said lugs are apertured; and said guiding means comprises a pair of rods in penetration of said lugs.

12. Means for engaging a movable edge of a door, which door has a latchbolt, for preventing door movement and delaying exit via the door, comprising:

a support mountable to the frame of a doorway in confronting relationship to a movable edge of a door;

first means mounted to said support for intrusion thereof into a movable edge of the door to prevent door movement, in a first disposition, and (b) withdrawal from said edge, in a second disposition, to permit door movement; and second means mountable to the frame of the doorway operative in response to, and with a specific time delay following, a retraction of the door latchbolt, for changing said first means from one of said dispositions thereof to the other.

13. Means for engaging a door, which door has a latchbolt, for delaying exit via the door, comprising:

a support mountable to the frame of a doorway in adjacency to a peripheral surface of a door movably mounted in the doorway;

a bolt reciprocably mounted to said support for (a) overlying a surface of the door, in a first disposition of said bolt, to prevent door movement, and (b) withdrawal of said bolt from said surface, in a second disposition of said bolt, to permit door movement; and means mountable to such frame of the doorway operative in response to, and with a specific time delay following, a retraction of the door latchbolt, for changing said bolt from said first disposition thereof to said second disposition.

* * * * *